US010169962B1

(12) United States Patent
Walker et al.

(10) Patent No.: US 10,169,962 B1
(45) Date of Patent: Jan. 1, 2019

(54) OBJECT LOCATION DEVICE AND SYSTEM

(71) Applicants: Marion Kelly Walker, Rogers, AR (US); David Lee McClure, Rogers, AR (US)

(72) Inventors: Marion Kelly Walker, Rogers, AR (US); David Lee McClure, Rogers, AR (US)

( * ) Notice: Subject to any disclaimer, the term of this patent is extended or adjusted under 35 U.S.C. 154(b) by 0 days.

(21) Appl. No.: 15/477,553

(22) Filed: Apr. 3, 2017

(51) Int. Cl.

| | |
|---|---|
| ***G08B 5/36*** | (2006.01) |
| ***G08B 3/10*** | (2006.01) |
| ***G08B 17/00*** | (2006.01) |
| ***E03B 9/02*** | (2006.01) |
| *G08B 7/06* | (2006.01) |

(52) U.S. Cl.
CPC ..... *G08B 5/36* (2013.01); *E03B 9/02* (2013.01); *G08B 3/10* (2013.01); *G08B 17/00* (2013.01); *G08B 7/064* (2013.01)

(58) Field of Classification Search
CPC . G08B 5/36; G08B 3/10; G08B 17/00; G08B 7/064; E03B 3/10; E03B 9/02
USPC ..... 116/200, 209, 142 FP
See application file for complete search history.

(56) References Cited

U.S. PATENT DOCUMENTS 924,803 A * 6/1909 Long ..... G08B 13/08 105/395
3,410,088 A * 11/1968 Cohen ..... E05F 15/75 49/265
3,886,352 A * 5/1975 Lai ..... H03K 17/292 250/215
4,023,151 A * 5/1977 Markham ..... G08B 21/24 340/328
4,074,225 A * 2/1978 Vandeweghe ..... A62B 3/00 340/329
4,642,477 A * 2/1987 Grzanowski, Jr. ..... G08B 7/064 307/112
4,736,186 A * 4/1988 Jones ..... G08B 7/064 340/331
5,103,214 A * 4/1992 Curran ..... G08B 29/10 340/292
5,117,223 A * 5/1992 Tanner ..... G08B 13/00 312/240
5,153,567 A * 10/1992 Chimento ..... G08B 7/062 169/23

(Continued)

*Primary Examiner* — R. A. Smith
*Assistant Examiner* — Tania Courson
(74) *Attorney, Agent, or Firm* — Schrantz Law Firm, PLLC; Stephen D. Schrantz

(57) ABSTRACT

The alert system notifies the user, such as a first responder, to a response location at which a responder aid device is located. Such a responder aid device aids the user in responding to an emergency or alarm condition. The alert system communicates with the emergency detection system of a building. The emergency detection system detects emergency conditions, such as fire, carbon monoxide, ammonia levels, and other emergency conditions. The alert system receives the emergency signal from the emergency detection system. The alert system activates at least one beacon or multiple beacons. These beacons show the location of the responder aid device through an alert, such as a visual alert and/or an audible alert. A monitor device alerts the users as to which responder aid devices have been used, applied, or otherwise employed in response to the alarm or emergency conditions.

20 Claims, 15 Drawing Sheets

(56) References Cited

U.S. PATENT DOCUMENTS 5,257,007 A * 10/1993 Steil ..... G08B 25/10 340/531
5,311,168 A * 5/1994 Pease, Jr. ..... E05B 45/06 200/61.93
5,572,183 A * 11/1996 Sweeney ..... G08B 7/062 340/332
5,793,280 A * 8/1998 Hincher ..... A62C 13/78 169/51
5,815,068 A * 9/1998 Vadseth ..... A62B 3/00 340/332
5,952,919 A * 9/1999 Merrill ..... G08B 25/12 340/539.11
6,107,941 A * 8/2000 Jones ..... G08G 1/0955 116/63 R
6,124,796 A * 9/2000 Hincher ..... G08B 7/06 340/321
6,181,251 B1 * 1/2001 Kelly ..... G08B 7/062 340/628
6,420,970 B1 * 7/2002 Kampmann ..... E05B 45/06 340/540
6,758,160 B1 * 7/2004 Martin ..... E03B 9/06 116/201
6,873,256 B2 * 3/2005 Lemelson ..... G08B 7/066 340/511
6,977,596 B1 * 12/2005 Brown ..... G08B 7/06 169/60
7,211,771 B1 * 5/2007 Smith ..... E01F 9/40 116/202
7,315,143 B2 * 1/2008 Mullet ..... G07C 9/00182 318/16
7,538,688 B1 * 5/2009 Stewart ..... E01F 13/028 116/63 C
7,798,669 B2 * 9/2010 Trojanowski ..... B63B 51/02 340/321
8,644,792 B2 * 2/2014 Lontka ..... G08B 7/06 340/506
9,217,242 B1 * 12/2015 Jones ..... E03B 9/04
9,514,583 B2 * 12/2016 Zasowski ..... G07C 9/00126
9,928,702 B2 * 3/2018 Bauldree ..... G08B 7/064
2003/0140666 A1 * 7/2003 Darcy ..... E05B 47/00 70/264
2003/0234725 A1 * 12/2003 Lemelson ..... G08B 7/066 340/521
2008/0253541 A1 * 10/2008 Kugel ..... E05B 41/00 379/168
2009/0128355 A1 * 5/2009 Urbin ..... G08B 5/00 340/815.4
2010/0201538 A1 * 8/2010 Stevens ..... G09F 13/04 340/691.1
2016/0063824 A1 * 3/2016 Fiore ..... G08B 5/38 340/691.8
2018/0158293 A1 * 6/2018 Bauldree ..... G08B 7/064

* cited by examiner

OBJECT LOCATION DEVICE AND SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

The present invention relates generally to emergency responses and methods to quicken the response to emergencies. The present invention more specifically relates to an alert and notification system alerting users to a response location identifying the position and location of important items/devices in response to an emergency. More specifically, the system alerts users to the response locations of fire department connections, fire suppression systems, entry systems, such as a Knox Box entry system, shut offs, main electrical shut off, gas shut off, shut offs for industrial operations, shut offs, shut off valves, shut off switches, bleed valves, and other emergency needs.

The alert system of the present invention implements a communication system that can both receive and transmit signals concerning an alarm or other emergency. The alert system communicates with an emergency detection system that detects emergency and/or environmental conditions. The alert system receives the alarm and activates a visual alert, such as a light, a strobe light, a spot light, or an audible alert, such as an alarm, an audible tone, or other alert. The alert assists the user in locating the important item/device for responding to the emergency.

DESCRIPTION OF THE KNOWN ART

Patents and patent applications disclosing relevant information are disclosed below. These patents and patent applications are hereby expressly incorporated by reference in their entirety.

U.S. Pat. No. 6,758,160 issued to Martin on Jul. 6, 2004 ("the '160 patent") teaches a hydrant locator that facilitates the location of a hydrant by firefighters. The device taught by the '160 patent is a series of strobe lights attached to a low profile device that wraps around a fire hydrant. Solar panels are placed between the various strobe lights to provide power to the device. The device taught in the '160 patent is then secured in place through a latch.

The '160 patent teaches that emergency responders are able to communicate with the device through a receiver mounted on the light device. An emergency responder may initiate a remote switch located within the emergency response vehicle, causing the strobe light on the hydrant to become illuminated. The switch taught in the '160 patent also has the ability to activate strobe lights of a different color to indicate the relative closeness of the hydrant.

U.S. Patent Publication No. 20090128355 applied for by Urbin and published on May 21, 2009 ("the '355 publication") teaches a method for visibly marking a water output. One embodiment taught by the '355 publication is a ring-shaped body containing a light emitting means and a solar cell to power the light emitting device. The light emitting portion of the device taught in the '355 publication serves to indicate the location of a water source such as a fire hydrant to fire fighters.

U.S. Pat. No. 9,217,242 issued to Jones on Dec. 22, 215 ("the '242 patent") teaches a solar powered fire hydrant attachment for remote hydrant reconnaissance. The system taught in the '242 patent contains a band of lamps powered by a solar battery circuit. The '242 patent teaches that the various color lights and the rate at which they blink correlates to the water pressure of the specific hydrant. The system taught in patent '242 also consists of a display screen which provides flow and pressure information.

U.S. Pat. No. 6,124,796 issued to Hincher on Sep. 26, 2000 ("the '796 patent") teaches a fire equipment bracket that also contains a locating beacon. The bracket taught in the '796 patent has a structure for holding a fire extinguisher and other safety related articles, as well as a structure for attaching the bracket to an environmental surface such as a wall. The locating beacon taught in the '796 patent may be audible, visual, or both.

U.S. Pat. No. 8,644,792 issued to Lontka on Feb. 4, 2014 ("the '792 patent") teaches an emergency device or emergency system is configured for operation within a fire safety system, or a fire safety portion of a building automation system (BAS). For example, the '792 patent teaches that wireless devices, emergency devices and/or automation components within the fire safety system, or the fire safety portion of the BAS may be configured to automatically provide or otherwise communicate emergency information to an emergency device or system. The emergency information taught by the '792 patent may, in turn, be utilized by emergency personnel or first responders to determine conditions with the structure. A heads-up display taught by the '792 patent is configured to present the display data based on the received emergency communication to a user.

The known art does not provide the communication with the emergency detection system and the notifications needed to provide a quicker response.

SUMMARY OF THE INVENTION

The present invention provides an alert system notifying the user, such as a first responder, to a response location at which a responder aid device is located. Such a responder aid device may include but is not limited to, a water source, a hydrant, a fire department connection (FDC), a standpipe, a dry riser, fire suppression systems, entry systems, such as a Knox Box entry system, shut offs, main electrical shut off, gas shut off, shut offs for industrial operations, shut off valves, shut off switches, emergency valves, bleed valves, safety valves, and other emergency needs.

The alert system communicates with an emergency detection system of a building or other emergency detection systems. The emergency detection system detects emergency conditions, such as fire, carbon monoxide, ammonia levels, access into areas, such as hazardous areas, conditions at a PIV, off normal change in state, supervisory tamper, alarm, and other emergency conditions. The alert system receives the emergency signal from the emergency detection system.

The alert system activates at least one beacon or multiple beacons. These actuated beacons show the location of the responder aid device. The beacons provide an alert, including but not limited to a visual alert and/or an audible alert. The visual alert provides a light and/or strobe light that shines on or near the responder aid device. The audible alert provides a sound, noise, or other audible alert at or near the responder aid device.

One embodiment of the invention monitors the responder aid devices to determine if the aid device has been employed in response to the emergency. The system monitors the responder aid devices to be employed in response to the alarm. The system detects whether the responder has used, applied, or otherwise employed the use of the responder aid device(s).

A monitor device alerts the users as to which responder aid devices have been used, applied, or otherwise employed. The monitor confirms that the user, such as a responder, has employed the use of the responder aid device. The monitor also identifies the responder aid devices that have not been employed. The user can then identify which responder aid devices need to be addressed.

As discussed above, the responder aid devices may include but are not limited to a water source, a hydrant, a fire department connection (FDC), a standpipe, a dry riser, fire suppression systems, entry systems, such as a Knox Box entry system that provides the user with keys or other device or method of accessing the building, shut offs, main electrical shut off, gas shut off, shut offs for industrial operations, shut off valves, shut off switches, valves, bleed valves and other emergency needs. The monitor identifies which FDC or other suppression systems have been used by the responders. The monitor also identifies utilities that have been properly shut off. Such utilities may include gas and/or electricity. The system can also confirm that the ammonia supplies have been properly closed and shut off. The system can also open bleed valves or confirm that the bleed valves have been opened.

It is an object of the present invention to identify the location of the responder aid device.

It is another object of the present invention to monitor the responder aid devices that have been employed in response to the emergency detection system.

It is another object of the present invention to alert a user to the location of the responder aid device.

It is another object of the present invention to provide an alert system that communicates with existing emergency detection systems.

It is another object of the present invention to monitor emergency detection devices to alert users to potential emergencies.

It is another object of the present invention to provide a wireless system.

It is another object of the present invention to provide a wired system.

It is another object of the present invention to provide beacons that communicate with one another.

It is another object of the present invention to operate independently of an alarm system.

It is another object of the present invention to provide an independent back up to an alarm system.

It is another object of the present invention to update the status of the responder aid device.

It is another object of the present invention to monitor the responder aid devices that have been employed in response to the detected alarm.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
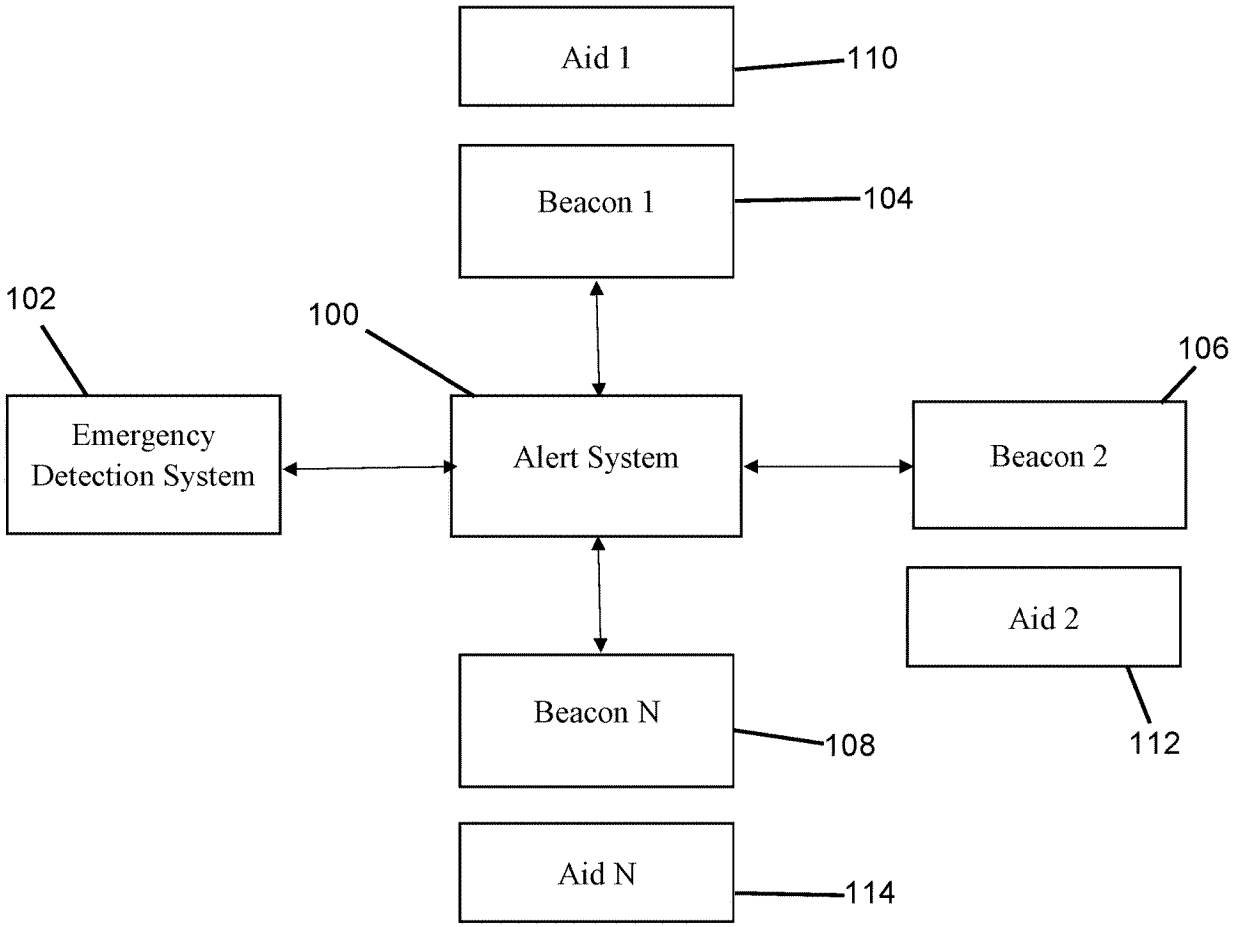
FIG. 1 is a schematic view of one embodiment of the present invention.

Referring to FIG. 1, the alert system, generally shown as 100, communicates with the emergency detection system 102. The alert system 100 communicates via a wired communication or a wireless communication. In one embodiment, the alert system 100 is an aftermarket product to be installed to existing emergency detection systems 102. In another embodiment, the alert system 100 is implemented in the emergency detection system 102.

The alert system communicates with the emergency detection system of a building. The emergency detection system detects emergency conditions, such as fire, carbon monoxide, ammonia levels, and other emergency conditions. The emergency detection system 102 transmits an emergency signal upon detection of an emergency. The alert system receives the emergency signal from the emergency detection system. The alert system monitors the emergency detection system 102 to determine if an emergency exists.

The emergency detection system 102 may include, but is not limited to, an alarm system, a post indicator valve, a pressure switch, a tamper switch, a supervisory switch, a flow switch, a dry set of contacts, a push button, a relay, a door switch, a door sensor, or other detection device. These emergency detection systems transmit an emergency signal, such as an alarm, an off normal change in state, supervisory tamper or other emergency signal. The emergency signal may be transmitted wirelessly or through a wired connection. If the emergency signal is transmitted through a wired communication, a transmitter connects to the emergency detection system to enable wireless transmission of the emergency signal to the alert system. The alert system receives the emergency signal from the emergency detection device. The transmitter then transmits the emergency signal from the emergency detection device to the appropriate beacons.

The emergency detection system can function with an alarm system. The emergency detection system can also function as an independent, stand-alone system without an alarm system. The alert system monitors the emergency detection devices identified above to determine if an emergency condition exists.

The alert system 100 notifies the user and/or users, such as first responders, firemen, policemen, emergency services, building personnel, employees, staff, and other people, to a response location at which the responder aid devices 110, 112, 114 are located. These responder aid devices 110, 112, 114 provide tools, devices, equipment, shut offs, bleed valves, valves, and other aids that assist in responding to the emergency.

Figure 15:
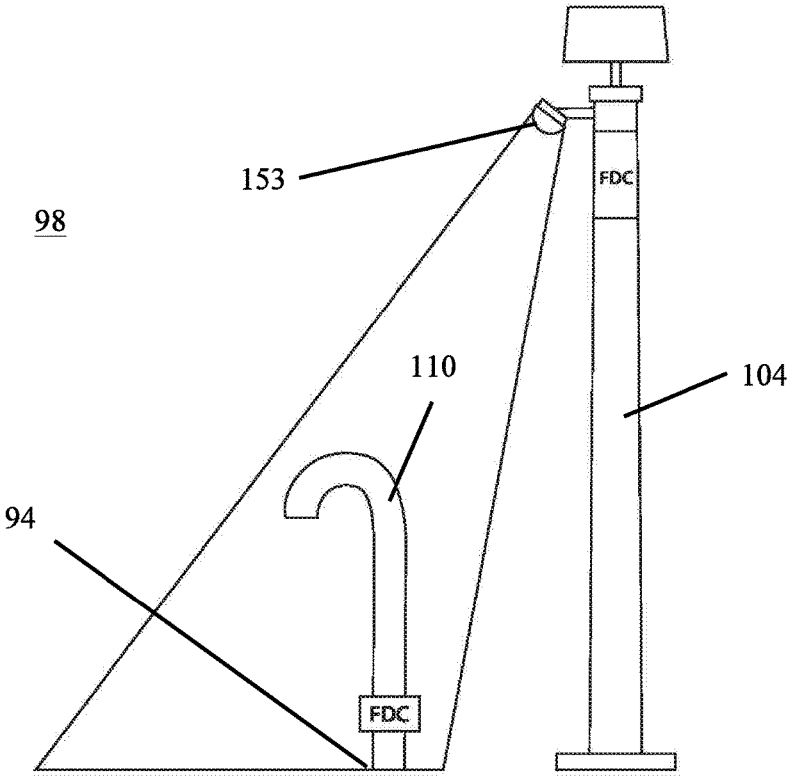
FIG. 15 is an environmental view of one embodiment of the present invention.
Figure 16:
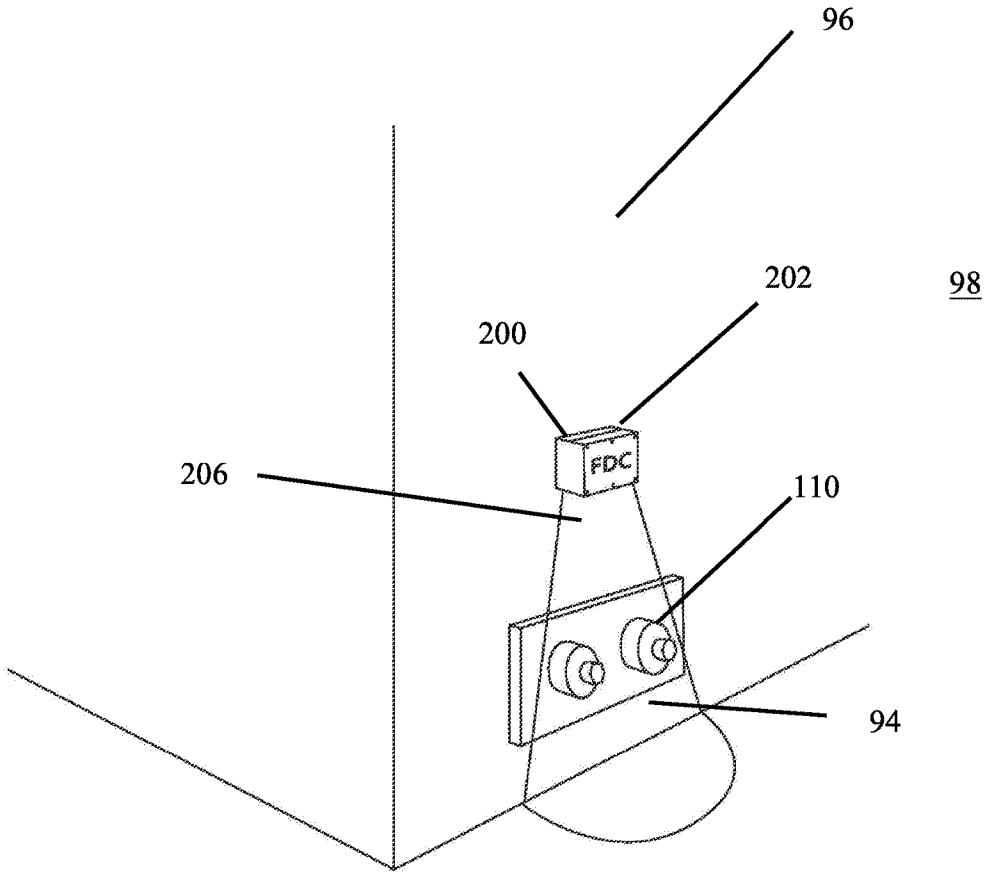
FIG. 16 is an environmental view of one embodiment of the present invention.

The responder aid device is located at a response location 94 which may be a critical area of control and/or interest. As shown in FIGS. 1, 15, and 16, beacon 104, 200 associated with at least one responder aid device 110 receives the emergency signal and activates the beacon to illuminate the responder aid device. Such a responder aid device 110, 112, 114 may include but is not limited to, a water source, a hydrant, a fire department connection (FDC), a standpipe, a dry riser, fire suppression systems, entry systems, such as a Knox Box entry system, shut offs, main electrical shut off, gas shut off, shut offs for industrial operations, shut off valves, shut off switches, bleed valves, valves, and other emergency needs.

In one embodiment that monitors the pressures within a conduit, the system can warn the users of increased pressure within the conduit. The system warns the user of the increased pressure. The beacon indicates the location of the bleed valve associated with the conduit. In one embodiment, an actuator installs onto the bleed valve. The actuator adjusts the bleed valve between the open position and the closed position. When the pressure reaches a particular level, the actuator automatically opens the bleed valve. In another embodiment, the user must manually open the bleed valve or approve opening the bleed valve.

As shown in FIGS. 1 and 15, beacons 104, 106, 108 notify the user, such as a first responder, to the location of the responder aid device 110, 112, 114. The alert system 100 activates at least one beacon 104, 106, 108 or multiple beacons. These beacons 104, 106, 108 show the location of the responder aid device 110, 112, 114. The beacons 104, 106, 108 provide an alert, including but not limited to a visual alert and/or an audible alert. The visual alert provides a light 153 or strobe light that shines on or near the responder aid device 110, 112, 114. The audible alert provides a sound, noise, or otherwise audible alert at or near the responder aid device 110, 112, 114.

The emergency detection system 102 detects emergency conditions at a business, building, location, industry, or other location. The emergency detection system 102 may detect fires, carbon monoxide, ammonia, increased valve pressure, and other emergency conditions. The emergency detection system 102 transmits an emergency signal to the alert system 100. The alert system 100 receives the emergency signal from the emergency detection system 102.

The alert system 100 identifies the type of emergency from the emergency signal. The alert system 100 then activates the appropriate beacons 104, 106, 108 for the identified emergency. For example, some emergencies may not require particular responder aid devices. The alert system 100 activates the beacons to be employed for the emergency. The alert system 100 of one embodiment activates only those beacons directed towards the responder aid devices to be employed. The remaining beacons of such an embodiment will not activate.

Each beacon 104, 106, 108 communicates with the alert system 100. In one embodiment, the beacons 104, 106, 108 communicate directly with each other. The beacons 104, 106, 108 direct the users to a response location of at least one specific responder aid device 110, 112, 114 or multiple responder aid devices. The beacons 104, 106, 108 provide an aid identifier that informs the user the type of responder aid device located by the beacon 104, 106, 108.

The beacons 104, 106, 108 of one embodiment monitor the use of the responder aid devices 110, 112, 114. The beacons 104, 106, 108 confirm whether the user has properly used, applied, or otherwise employed the use of the responder aid device 110, 112, 114. The monitoring device will indicate which responder aid devices have been employed in response to the emergency.

The beacons 104, 106, 108 can communicate with one another to activate each beacon suggested for the emergency. One beacon may receive the emergency signal. The beacon then transmits the emergency signal to the other beacons to activate the suggested beacons. The beacons may also communicate with each other to identify the responder aid devices that have been employed in response to the alarm.

Figure 2:
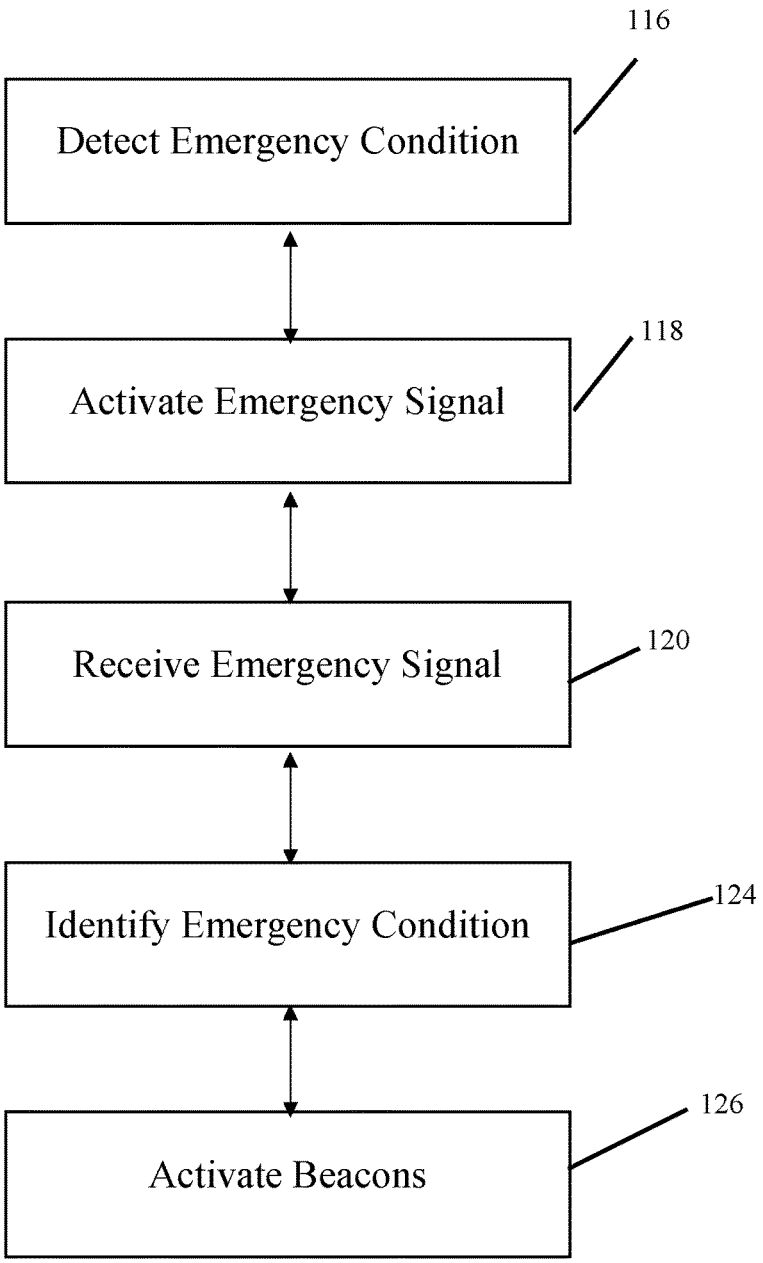
FIG. 2 is a flow diagram of one embodiment of the present invention.

FIG. 2 shows the process of activating the beacons. The emergency detection system at the location implements detectors that identify particular emergency conditions. These detectors include, but are not limited to, fire detectors, noxious gas detectors, fatal gas detectors, a post indicator valve, a pressure switch, a tamper switch, a supervisory switch, a flow switch, a dry set of contacts, a push button, a relay, a door switch, a door sensor, or other detection device. These detectors communicate with the emergency detection system. The detectors activate the emergency signal when an emergency condition is detected at Detect Emergency Condition 116. The emergency signal is then activated at Activate Emergency Signal 118.

In one embodiment, the alert system monitors the post indicator valve (PIV) to detect an emergency condition. The PIV transmits an emergency signal through a wired connection. Monitoring such an emergency signal may require significant difficulties. To avoid such problems, the alert system attaches a wireless transmitter to the PIV. The alert system then communicates with and monitors the PIV to detect emergency conditions.

The activated emergency signal from the emergency detector system transmits an emergency signal to the alert system. The emergency signal may be sent to the alert system or directly to at least one of the beacons. The alert system and/or the beacons receive the emergency signal at Receive Emergency signal 120. The alert system and/or the beacons then transmit the emergency signals to the beacons associated with the responder aid devices suggested for the response to the emergency.

The alert system identifies the emergency condition at identify emergency condition 122. Each emergency condition may require a different emergency response. The response may involve activating, using, or otherwise employing particular responder aid devices in response to the detected emergency condition.

Each beacon is associated with at least one responder aid device or multiple responder aid devices. The alert system identifies which responder aid device(s) may be useful in addressing the emergency detected by the emergency detection system. Depending upon the detected emergency, the system notifies the users to the locations of the suggested responder aid devices for responding to the emergency.

The alert system then activates the beacons at activate beacons 124. The alert system activates the beacons suggested for responding to the emergency. In another embodiment, the alert system activates all of the beacons. The active beacons provide an alert identifying the response location. The alert may be a visual alert, an audible alert, or both.

Figure 3:
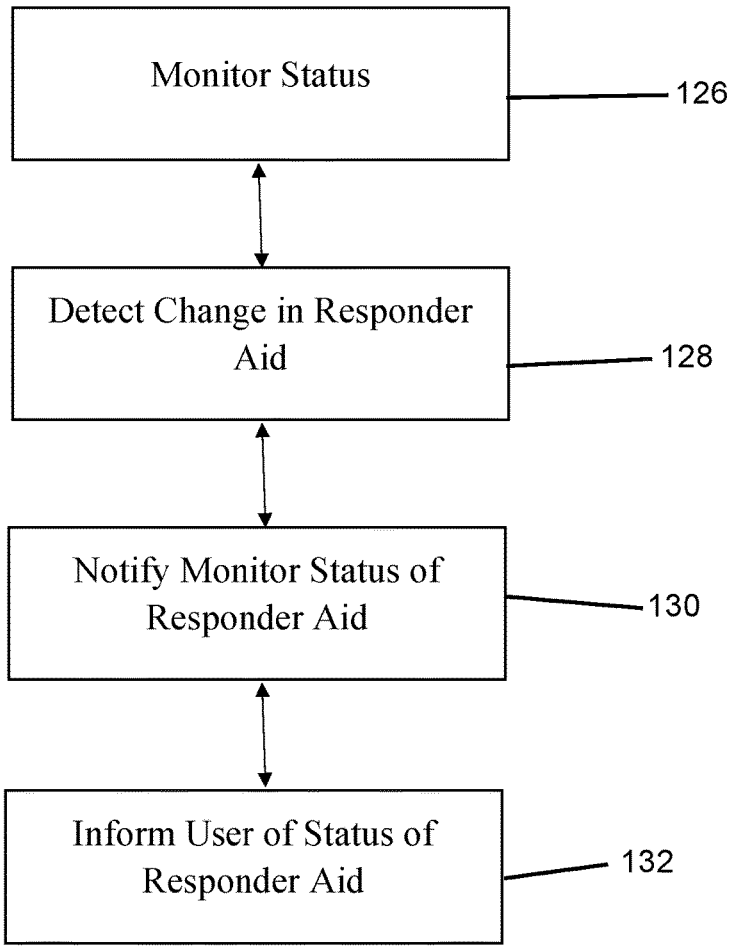
FIG. 3 is a flow diagram of one embodiment of the present invention.

FIG. 3 shows the monitoring of the responder aid devices. The responder aid devices assist the users in responding to the emergency. The responder quickens the response time to the emergency.

At least one monitor device monitors the alert system and the use of the responder aid devices. Multiple monitors may be implemented in the system to allow more than one user to monitor the use of the responder aid devices.

The alert system monitors whether the responder aid device has been employed in response to the alarm at Monitor Status 126. The alert system detects whether the responder aid device has been employed in response to the alarm at Detect Change in Responder Aid Device 128. The system detects whether the responder has used, applied, or otherwise employed the use of the responder aid device(s).

The alert system transmits an activated signal to the alert system indicating that the responder aid device has been activated, used or otherwise employed. The system notifies the monitor the status of the responder aid device at Notify Monitor 130. The system detects a change in the status of the responder aid device. The responder aid device may transmit an activated signal indicating use of the responder aid device. Other detection devices may be installed or communicate with the responder aid devices. These detection devices determine if the responder aid device has been employed in response to the alarm.

The detector device transmits an employed signal to the monitoring system if the responder aid device has been employed in response to the alarm at Notify Monitor 130. The employed signal may be transmitted by the detector device or the beacon. In other embodiments, the system may transmit a not employed signal.

A monitor device alerts the users as to which responder aid devices have been used, applied, or otherwise employed. The monitor confirms that the user, such as a responder, has employed the use of the responder aid device. The monitor also identifies the responder aid devices that have not been employed. The user can then identify which responder aid devices need to be addressed.

The monitor identifies which responder aid devices have been employed in response to the alarm. The monitor quickly informs the user of the responder aid device(s) employed in response to the alarm at Notify User 132. The monitor system identifies any FDC or other suppression systems employed by the responders. The monitor also identifies utilities that have been properly shut off. Such utilities may include gas and/or electricity. The system also confirms that the ammonia supplies have been properly closed and shut off.

Figure 4:
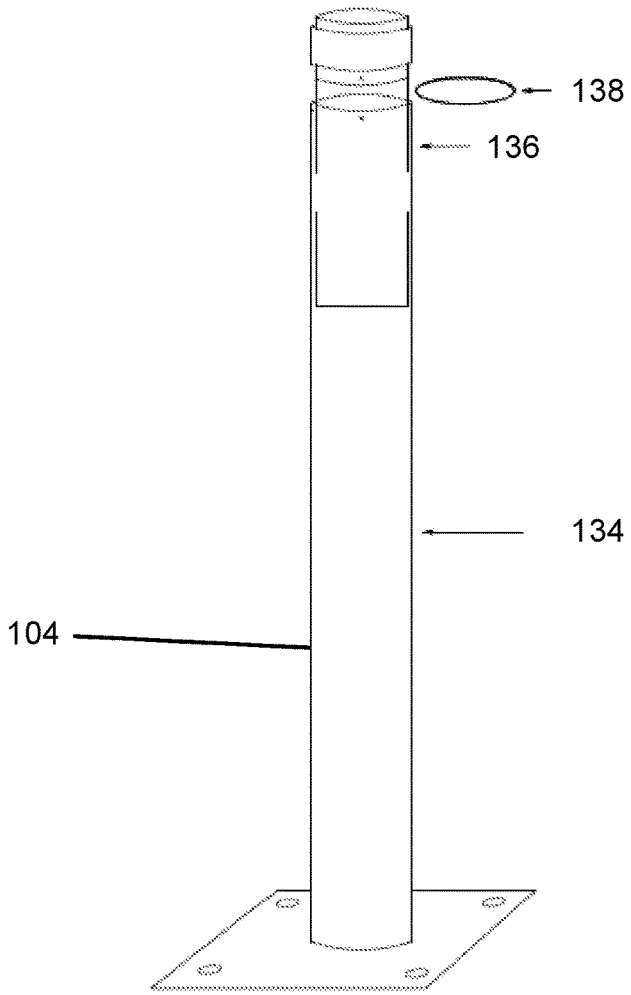
FIG. 4 is an exploded view of one embodiment of the present invention.

FIG. 4 shows the beacon 104 of the present invention. Beacon 104 provides an indicator to indicate the type of responder aid device that is located by the beacon 104. The beacon provides a visual alert, audible alert, or both directing the user to the location of the responder aid device.

The beacon 104 provides a mounting body 134 secured to a base that attaches to the ground or a building. The mounting body 134 elevates the indicator above the ground. The mounting body 134 also provides some separation from the building to provide greater emphasis on the indicator. The mounting body 134 provides an assembly aperture 136 for installing the electronic assembly 139 shown in FIG. 5. Seal 138, such as an O-ring, secures within the mounting body 134 to seal the electronics assembly 139 within the mounting body 134.

Figure 5:
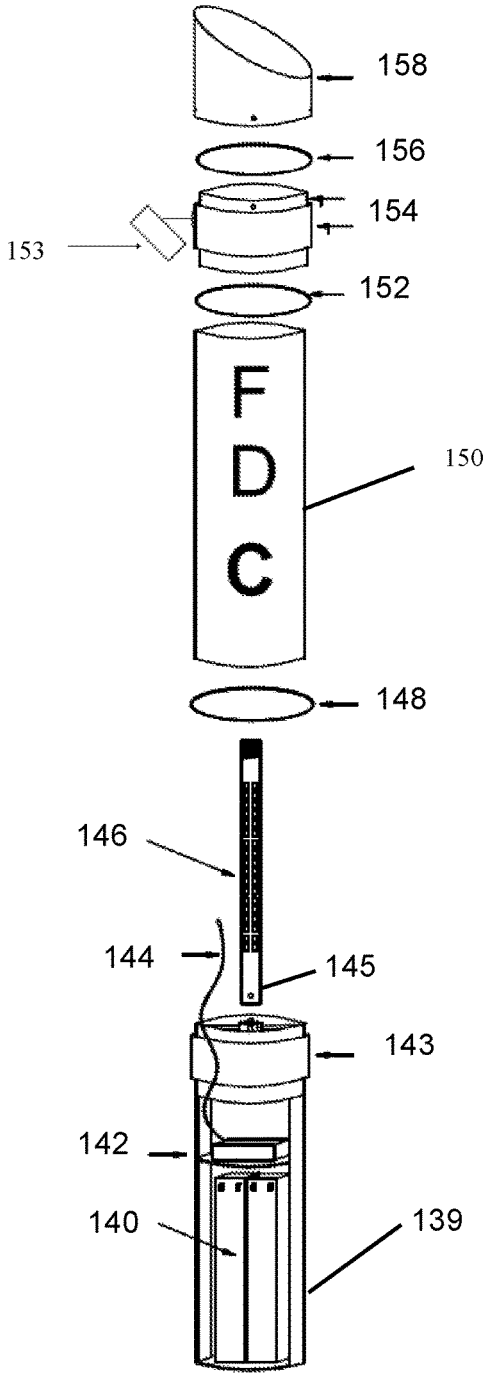
FIG. 5 is an exploded view thereof.

FIG. 5 shows the electronics assembly 139 for the beacon. A power source 140, such as batteries or an electrical connection, powers the beacon, including but not limited to the lights 146 and communication system 142. Antennae 144 of the communication system 142 increases the distance that the communication system 142 can receive and transmit signals. Seals 148, 152, 156, such as O-rings, seal the electronic assembly from the elements to allow outdoors 98 installation of the beacon as shown in FIGS. 15 and 16.

Identifier 150 informs the user of the responder aid devices available at the response location. The identifier 150 allows light from light 146 to pass through the identifier 150. The light passing through the identifier 150 illuminates the indicator 150 to draw the user's attention to the beacon and the responder aid device. In one embodiment, the indicator 150 is at least eighteen (18) inches in height. In another embodiment, the indicator 150 ranges in height from twelve inches to twenty four inches.

Attachment collars 143, 154 secure the identifier 150 to the beacon 104. Head 158 seals the uppermost portion of the beacon 104. The head 158 provides solar mounting capabilities for mounting solar panels. The solar panel may serve as a power source for operating the beacon or may charge the power source, such as the batteries. Similar to the attachment collar 154, the head 158 rotates to properly aim the solar panel. The head 158 locks into position to lock or otherwise limit the rotation of the head 158. Such locking of the head 158 into fixed position prevents adjustment of the head 158 to reduce the effectiveness of the solar panels.

FIG. 5 also shows adjustable light 153. The adjustable light 153 aims at the responder aid device to illuminate the responder aid device at the response location. The adjustable light 153 pivots up and down to properly aim the light at the response location. In one embodiment, the adjustable light 153 locks into position to prevent or otherwise limit pivoting of the adjustable light up and down.

The adjustable light 153 of one embodiment attaches to the top attachment collar 154. The attachment collar 154 of one embodiment rotates to adjust the direction of the light 153 for illuminating the response location. The attachment collar 154 locks into position to prevent or otherwise limit any additional adjustment of the light 154.

Figure 6:
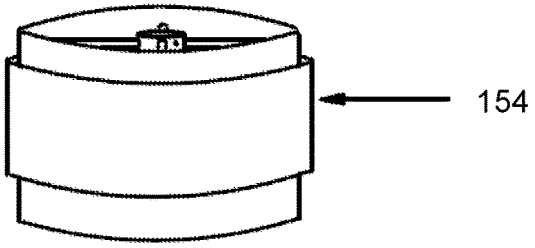
FIG. 6 is a perspective view of one component of one embodiment of the present invention.
Figure 7:
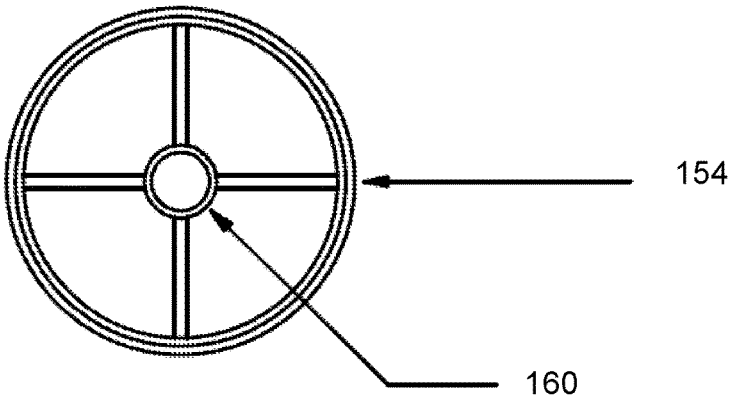
FIG. 7 is a top view thereof.
Figure 8:
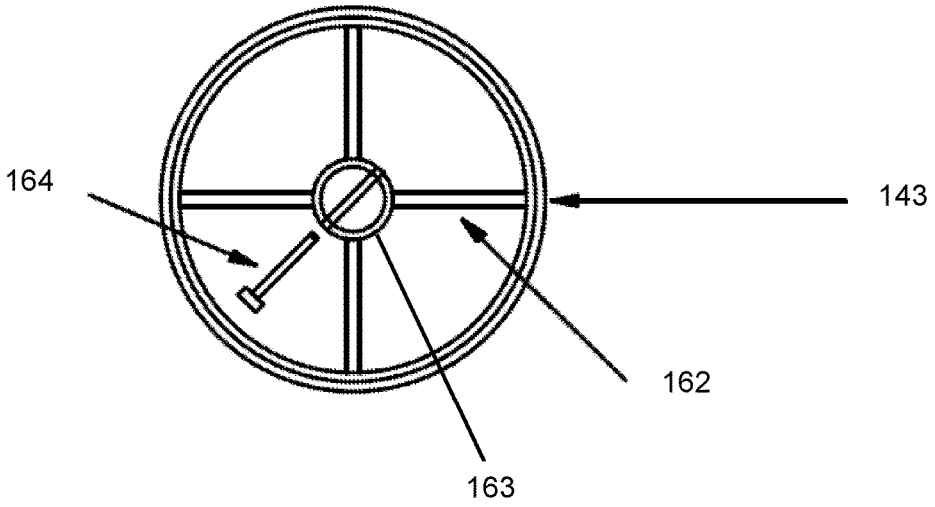
FIG. 8 is a bottom view thereof.

FIGS. 6-8 show the attachment collar 154 which is similar to attachment collar 143 except for the differences in the neck. The attachment collar 154 provides neck 160 for installation of the light 146 within the attachment collar 154. Neck 160 provides internal threads for installation of the top of light 146 into the neck 160. The top of light 146 also provides a threaded top to be inserted into neck 160 for securing the light 146 to attachment collar 154. Shoulders secure the neck 160 to the attachment collar 154. The shoulders increase the rigidity of the attachment collar 154.

Referring to FIG. 7, shoulders 162 increase the rigidity of necks 160, 163 and the attachment collar 143, 154. Shoulders 162 also place the necks 160, 163 within the attachment collars 154, 143.

Referring to FIG. 8, fastener 164 secures the light 146 within the attachment collar 143. The fastener 164 passes through the light 146 at the installation aperture 145 of the light 146 to install the light 146 within neck 163 of attachment collar 143.

Figure 9:
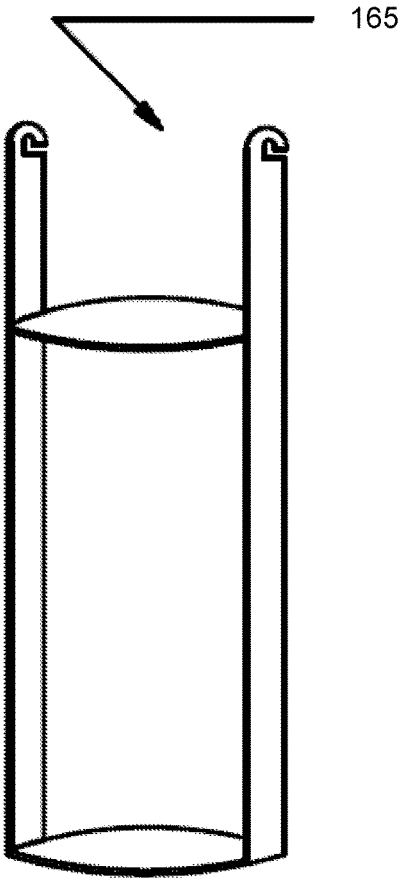
FIG. 9 is a perspective view of one component of one embodiment of the present invention.

FIG. 9 shows the battery housing 165 of the electronics assembly 139. The battery housing 165 provides two attachment arms for securing the battery housing 165 within the mounting body 134.

Figure 10:
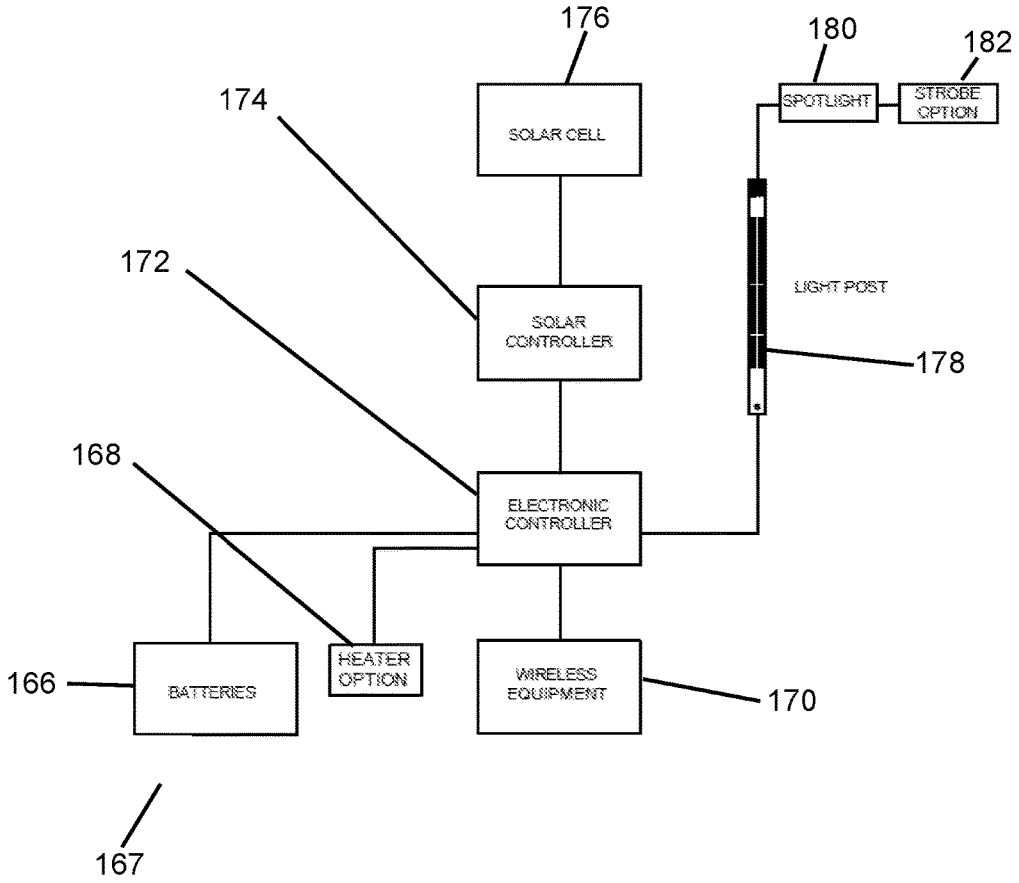
FIG. 10 is a schematic view of one component of the present invention.

FIG. 10 shows a schematic of a wireless beacon 167. The wireless beacon includes a power source 166, such as batteries. A heater 168 may be installed within the beacon to defrost the beacon or to heat the beacon to maintain proper functioning of the beacon. A communication system 170 transmits signals to the alert system, the other beacons, and the monitor. The communication system 170 also receives signals from the alert system, other beacons, the detection devices, or the responder aid device. The communication system 170 may include, but is not limited to transmitter(s), receiver(s), transceiver(s), Bluetooth devices, wired communication systems, and wireless communication systems.

The controller 172 determines the operation of the beacon. The controller determines the activation of the alert, such as the visual alert or the audible alert. The solar control 174 determines the operation of the solar cell 176 and the flow of the electricity generated by the solar cell 176. The solar cell 176 may power the alert system or charge the power source, such as the batteries.

The beacon is capable of producing different lighting options as the visual alert. The electronic controller 172 may activate the light 178, the spotlight 180, or the strobe light 182. Such different options provide the user with increased visibility of the beacon and the response location at which the responder aid device is located.

Figure 11:
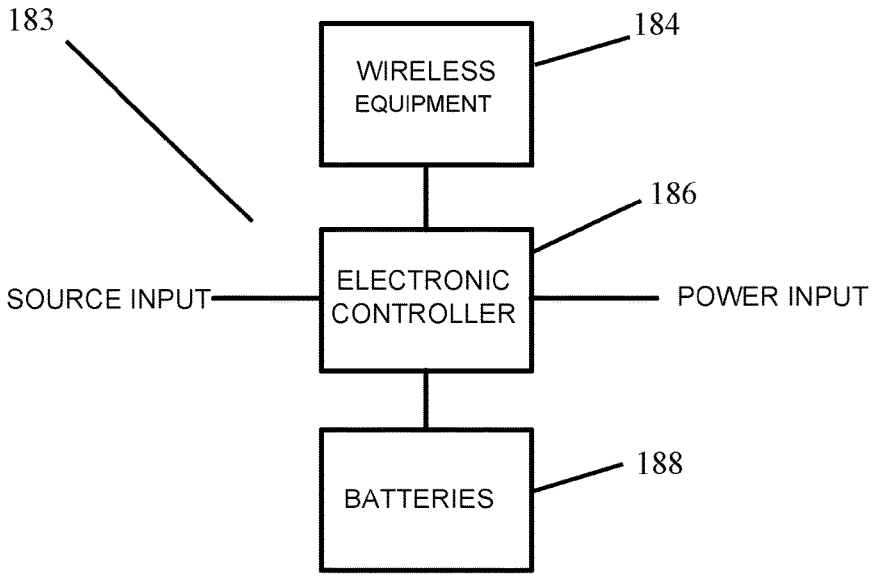
FIG. 11 is a schematic view of one component of the present invention.

FIG. 11 shows the activation controller 183 of the alert system. The activation controller 183 communicates with the emergency detection system. The emergency detection system serves as the source input of the controller 186. A power input and backup power source 188, such as batteries, power the electric controller 186 and the communication system 184. The communication system transmits the emergency signal and the detected emergency to the beacons to activate the appropriate beacons.

The communication system 184 of one embodiment also receives the employed signal indicating that a particular response aid device has been employed in response to the emergency. The communication system 184 may then transmit a signal to the monitoring system identifying which responder aid devices have been employed.

Figure 12:
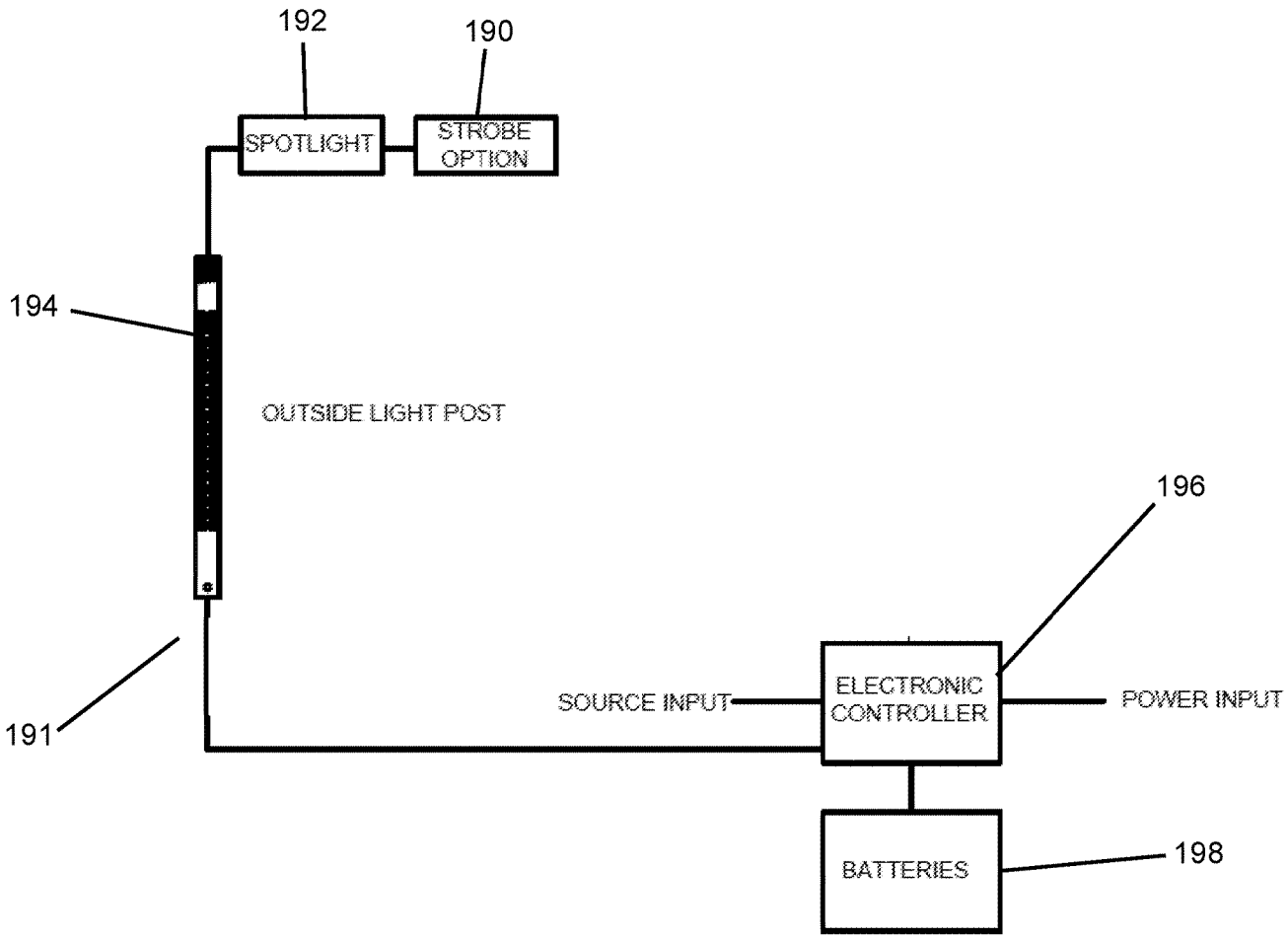
FIG. 12 is a schematic view of one component of the present invention.
Figure 13:
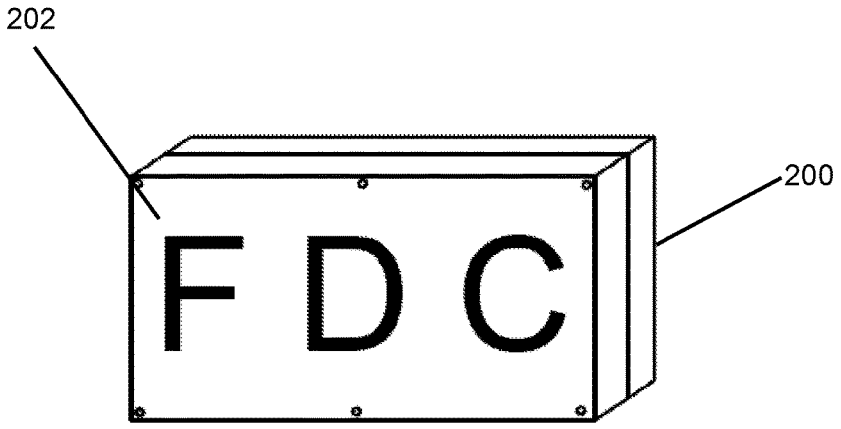
FIG. 13 is a perspective view of a beacon of one embodiment of the present invention.
Figure 14:
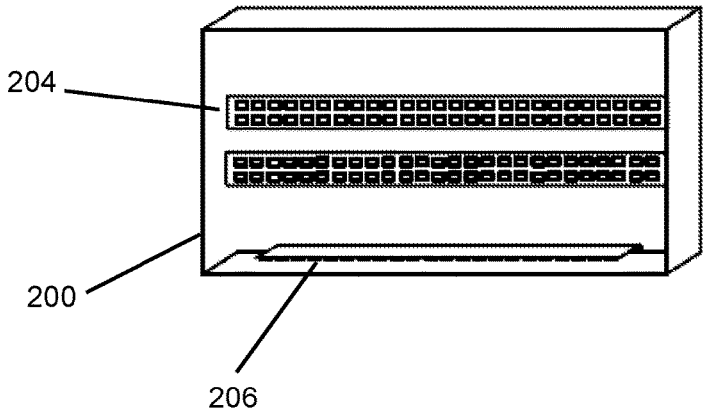
FIG. 14 is a partial view thereof.

FIG. 12 shows another embodiment of a beacon 191 that is wired to the emergency detection system. The beacon 191 is directly wired to the emergency detection system as the source input. Again, power source 198, such as batteries, provide backup power to the electric controller 196 for the power input. The electric controller 196 activates the alerts, such as the visual alert and/or the audible alert, FIGS. 13, 14, and 16 show another beacon 200 that secures to the building 96 or the responder aid device. The beacon provides an indicator 202. The indicator 202 shows the location of the response location of the responder aid device 110. Lights 204 within the beacon 200 draw the user's attention to the indicator 202 and the beacon 200.

FIGS. 14 and 16 show a translucent or transparent bottom wall that allows light 206 to illuminate through the bottom wall of the beacon 200. Such a beacon 200 installs above the response location. The light 206 shines down upon the response location 94 and the responder aid device 110 to illuminate the location and device. Such illumination from light 206 directs the user's attention to the response location 94 and the responder aid device 110.

The alert system communicates with an emergency detection system. Such a system allows users to retrofit an existing emergency detection system with the alert system. The alert system receives the emergency signal from the emergency detection system. The alert system avoids transmitting signals back to the emergency detection system. Such a system avoids interfering with the operation of the emergency detection system.

By installing the alert system without requiring signals returning to the emergency detection system, the alert system can be installed with any emergency detection system. The alert system simply relies on the emergency signal from the emergency detection system. The alert system retrofits with existing systems for simple installation.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An alert system in communication with an emergency detection system that detects emergency conditions of a building wherein the alert system directs a first responder to a response location at which a responder aid device that assists the first responder in responding to the emergency condition is located, the alert system comprising:

a beacon placed outside wherein the beacon communicates with the emergency detection system wherein the beacon receives an emergency signal from the emergency detection system that identifies the emergency condition;

a communication system that receives the emergency signal from the emergency detection system;

a seal that seals the communication system within the beacon;

an adjustable visual alert generated by the beacon after receiving the emergency signal through the communication system wherein the visual alert adjusts to identify a response location located outdoors to be accessed by the first responder at which the responder aid device is located for usage by the first responder.

2. The system of claim 1 further comprising:

an identifier of the beacon that indicates a type of responder aid device located at the response location wherein the identifier is backlit by a light that is sealed by the seal.

3. The system of claim 1 wherein the visual alert illuminates the response location.

4. The system of claim 3 wherein the visual alert is an adjustable light that shines upon the responder aid device to be used by the first responder.

5. The system of claim 4 wherein the light is an adjustable light that adjusts to aim in the direction of the response location.

6. The system of claim 5 wherein the adjustable light locks into position to limit adjustment of the direction in which the light is aimed.

7. The system of claim 3 wherein the light is a spot light is directed at the response location.

8. The system of claim 1 wherein the responder aid device is a fire department connection.

9. The system of claim 1 wherein the responder aid device is a shut off for a utility of the building.

10. The system of claim 1 wherein the responder aid device is an entry system that provides a locked key box.

11. An alert system in communication with an emergency detection system that detects emergency conditions of a building wherein the alert system directs a first responder to a response location at which a responder aid device that assists the user in responding to the emergency condition is located, the alert system comprising:

a beacon placed outside that communicates with the emergency detection systems;

a communication system that receives the emergency signal from the emergency detection system;

an alert generated by the beacon after receiving the emergency signal wherein the alert provides a visual alert that shines directly upon a response location at which the responder aid device is located to be employed by the first responder in response to the emergency;

an identifier identifying a type of responder aid device located at the response location;

an attachment collar that secures the identifier to the beacon; and a seal located between the attachment collar and the identifier to seal inside of the beacon.

12. The system of claim 11 wherein the visual alert is an adjustable light shining a spot light on the response location that adjusts to be aimed in the direction of the response location and the adjustable light locks into position to limit adjustment of the direction in which the light is aimed.

13. The system of claim 11 wherein the alert system monitors a pressure indicator valve.

14. The system of claim 11 wherein the alert system identifies at least one beacon to activate based upon the detected emergency wherein the alert system activates the alert of a beacon in response to receiving the emergency signal without activating an alert of a second beacon in response to the emergency signal.

15. The system of claim 11 wherein the alert system monitors a pressure valve, the alert system opening a bleed valve to relieve pressure from the pressure valve.

16. The system of claim 11 further comprising:

a heater installed within the beacon wherein the heater warms a battery within the beacon for proper functioning of the beacon.

17. The system of claim 11 further comprising:

a second seal wherein the first seal and the second seal seal the communication system within the beacon.

18. An alert system in communication with an emergency detection system that detects emergency conditions at a building wherein the alert system directs the user to a first response location at which a first responder aid device that assists the user in responding to the emergency condition is located and a second response location at which a second responder aid device that assists the user in responding to the emergency condition is located, the alert system comprising:

a first beacon placed outside of the building wherein the first beacon communicates with the emergency detection system wherein the first beacon receives an emergency signal that identifies the emergency condition without the alert system transmitting any communication to the emergency detection system;

an alert generated by the first beacon after receiving the emergency signal wherein the alert provides a visual alert that identifies the first response location at which the first responder aid device is located;

an identifier identifying a type of first responder aid device located at the first response location;

a second beacon placed outside of the building wherein the second beacon communicates with the emergency detection system wherein the second beacon receives the emergency signal that identifies the emergency condition without the alert system transmitting any communication to the emergency detection system;

an alert generated by the second beacon after receiving the emergency signal wherein the alert of the second beacon provides a visual alert that illuminates the second response location at which the second responder aid device is located; and an identifier of the second beacon identifying a type of second responder aid device located at the second response location;

a communication system of the first beacon that receives the emergency signal from the emergency detection system wherein the communication system of the first beacon does not transmit a signal to the emergency detection system;

a communication system of the second beacon that receives the emergency signal from the emergency detection system wherein the communication system of the second beacon does not transmit a signal to the emergency detection system.

19. The alert system of claim 18 wherein the alert system identifies at least one beacon to activate based upon the detected emergency and activates the alert device of the first beacon in response to receiving the emergency signal without activating the alert device of the second beacon in response to the emergency signal.

20. The alert system of claim 19 wherein the communication system of the first beacon communicates with the communication system of the second beacon.

* * * * *